US011214087B2

(12) United States Patent
Manabe et al.

(10) Patent No.: US 11,214,087 B2
(45) Date of Patent: Jan. 4, 2022

(54) AUTOMATIC DRAWING SYSTEM AND METHOD OF OPERATING AUTOMATIC DRAWING SYSTEM

(71) Applicant: Taikisha Ltd., Tokyo (JP)

(72) Inventors: Keiji Manabe, Tokyo (JP); Chikara Hasegawa, Tokyo (JP)

(73) Assignee: Taikisha Ltd., Tokyo (JP)

( * ) Notice: Subject to any disclaimer, the term of this patent is extended or adjusted under 35 U.S.C. 154(b) by 60 days.

(21) Appl. No.: 16/637,825

(22) PCT Filed: Jun. 20, 2019

(86) PCT No.: PCT/JP2019/024469

§ 371 (c)(1),
(2) Date: Feb. 10, 2020

(87) PCT Pub. No.: WO2020/079889

PCT Pub. Date: Apr. 23, 2020

(65) Prior Publication Data

US 2020/0282755 A1 Sep. 10, 2020

(30) Foreign Application Priority Data

Oct. 17, 2018 (JP) ..... JP2018-195896

(51) Int. Cl.

| | |
|---|---|
| ***B41M 3/00*** | (2006.01) |
| *B41J 3/407* | (2006.01) |
| *B05B 13/04* | (2006.01) |

(52) U.S. Cl.
CPC ..... *B41M 3/005* (2013.01); *B05B 13/0431* (2013.01); *B41J 3/4073* (2013.01)

(58) Field of Classification Search
CPC ..... B41J 3/4073; B41M 3/005; B05B 5/00; B05B 13/0431; B05B 13/0436; B05B 13/0442; B05B 13/0405
See application file for complete search history.

(56) References Cited

U.S. PATENT DOCUMENTS

| | | | |
|---|---|---|---|
| 5,642,476 | A | 6/1997 | Turner |
| 6,014,146 | A | 1/2000 | Freeman |
| 2009/0244629 | A1 | 10/2009 | Hattori |

(Continued)

FOREIGN PATENT DOCUMENTS

| | | | |
|---|---|---|---|
| CN | 105289884 | A | 2/2016 |
| CN | 106041936 | A | 10/2016 |

(Continued)

*Primary Examiner* — Matthew G Marini
*Assistant Examiner* — Marissa Ferguson-Samreth
(74) *Attorney, Agent, or Firm* — The Webb Law Firm

(57) ABSTRACT

An object of the present invention is to provide an automatic drawing system capable of drawing a figure having a smooth and clear contour, in which a control apparatus, based on figure data of a planned drawing figure, by operation of a cartesian coordinate robot, moves a paint discharging apparatus parallel to a contour line of the planned drawing figure to be drawn at a planned drawing location, and along with this movement, the control apparatus executes contour parallel drawing control that causes the paint discharging apparatus to continuously perform a paint discharging operation, thereby drawing a contour portion of the planned drawing figure.

7 Claims, 6 Drawing Sheets

(56) References Cited

U.S. PATENT DOCUMENTS

| | | | |
|---|---|---|---|
| 2015/0375390 | A1 | 12/2015 | Becroft et al. |
| 2016/0306364 | A1 | 10/2016 | Ikushima |
| 2017/0267002 | A1 | 9/2017 | Pitz et al. |
| 2019/0039386 | A1 | 2/2019 | Schmidt |

FOREIGN PATENT DOCUMENTS

| | | | | | |
|---|---|---|---|---|---|
| DE | 102016201821 | A1 | | 8/2017 | |
| JP | H231850 | A | | 2/1990 | |
| JP | 04111490 | | * | 4/1992 | ..... H05K 3/10 |
| JP | H4111490 | A | | 4/1992 | |
| JP | H7299403 | A | | 11/1995 | |
| JP | H8173874 | A | | 7/1996 | |
| JP | H9225865 | A | | 9/1997 | |
| JP | H11291466 | A | | 10/1999 | |
| JP | 2004209311 | A | | 7/2004 | |
| JP | 2005338301 | A | | 12/2005 | |
| JP | 2011235237 | | * | 11/2011 | ..... B05D 3/00 |
| JP | 2011235237 | A | | 11/2011 | |
| JP | 201554269 | A | | 3/2015 | |
| WO | 2015083722 | A1 | | 6/2015 | |

* cited by examiner

AUTOMATIC DRAWING SYSTEM AND METHOD OF OPERATING AUTOMATIC DRAWING SYSTEM

CROSS-REFERENCE TO RELATED APPLICATIONS

This application is the United States national phase of International Application No. PCT/JP2019/024469 filed Jun. 20, 2019, and claims priority to Japanese Patent Application No. 2018-195896 filed Oct. 17, 2018, the disclosures of which are hereby incorporated by reference in their entirety.

TECHNICAL FIELD

The present invention relates to an automatic drawing system provided with a paint discharging apparatus, a cartesian coordinate robot, and a control apparatus, and also relates to a method of operating that automatic drawing system. Here, the paint discharging apparatus discharges paint toward a drawing target face according to a discharge command given from the control apparatus. Also, the cartesian coordinate robot includes an X-axis slider that linearly moves the paint discharging apparatus in an X-axis direction, and a Y-axis slider that linearly moves the X-axis slider in a Y-axis direction orthogonal to the X-axis direction. Also, the control apparatus controls the cartesian coordinate robot and the paint discharging apparatus based on position information of a planned drawing location in a drawing target face and figure data of a planned drawing figure, so as to draw the planned drawing figure at the planned drawing location by discharging paint from the paint discharging apparatus.

BACKGROUND ART

Conventionally, in this type of automatic drawing system (see Patent Document 1), in order to draw a planned drawing figure G such as a design or a character at a planned drawing location of a drawing target face S by discharging paint from a paint discharging apparatus, the following sort of method is adopted. That is, as shown in FIG. 10, each time an X-axis slider is moved by a set unit movement amount Δy in a Y-axis direction by operation of an Y-axis slider, the paint discharging apparatus is moved along the drawing target face S in a square wave-shaped movement path K in which the paint discharging apparatus is linearly moved in the X-axis direction by operation of the X-axis slider.

In the process of moving the paint discharging apparatus in the square wave-shaped movement path K, the control apparatus performs start/stop control of the paint discharging apparatus in which a paint discharging operation of the paint discharging apparatus is started every time the paint discharging apparatus enters the area of the planned drawing figure G (indicated by unfilled circles in FIG. 10), and the paint discharging operation of the paint discharging apparatus is stopped every time the paint discharging apparatus exits the area of the planned drawing figure G (indicated by solid circles in FIG. 10). Thus, the planned drawing figure G is drawn on the drawing target face S. (Hereinafter, this type of control is abbreviated as "X-axis parallel drawing control").

PRIOR ART DOCUMENTS

Patent Documents

Patent Document 1: JP H11-291466A (particularly, paragraph [0016] and FIG. 1)

DISCLOSURE OF THE INVENTION

Problems to be Solved by the Invention

However, there is a slight difference between the time at which the control apparatus gives a paint discharging operation ON/OFF command to the paint discharging apparatus and the time at which the paint discharging apparatus actually starts/stops the paint discharging operation. Therefore, in the above-described X-axis parallel drawing control, as schematically shown in FIG. 11, a drawing error Δe occurs between the end of each drawing line segment L extending in the X-axis direction and a contour line g of the planned drawing figure G. As a result, a disturbance such as occurrence of fine irregularities occurs in the contour of the planned drawing figure G after being drawn on the drawing target face S, so there is a problem that the contour accuracy of the drawing figure is reduced.

In view of this situation, the present invention mainly aims to effectively solve the above problem by adopting a rational drawing mode.

Means for Solving Problems

A first characteristic configuration of the present invention relates to an automatic drawing system including a paint discharging apparatus, a cartesian coordinate robot, and a control apparatus; the paint discharging apparatus discharging paint toward a drawing target face according to a discharge command given from the control apparatus; the cartesian coordinate robot having an X-axis slider that linearly moves the paint discharging apparatus in an X-axis direction, and a Y-axis slider that linearly moves the X-axis slider in a Y-axis direction orthogonal to the X-axis direction; and the control apparatus controlling the cartesian coordinate robot and the paint discharging apparatus so as to draw a planned drawing figure at a planned drawing location in the drawing target face by discharging paint from the paint discharging apparatus, based on position information of the planned drawing location and figure data of the planned drawing figure. In this automatic drawing system, the control apparatus, in drawing of a contour portion in the planned drawing figure, as control for the cartesian coordinate robot and the paint discharging apparatus, based on the figure data, by operation of the cartesian coordinate robot, moves the paint discharging apparatus parallel to a contour line of the planned drawing figure to be drawn at the planned drawing location, and along with that movement, executes a contour parallel drawing control that causes the paint discharging apparatus to continuously perform a paint discharging operation.

With this configuration, in the drawing of the contour portion in the planned drawing figure, occurrence of the drawing error Δe as described above (that is, the drawing error that occurs between the end of each drawing line segment L that extends in the X-axis direction and the contour line g of the planned drawing figure G, caused by a time error that occurs between the time when the control apparatus gives a paint discharging operation ON/OFF command to the paint discharging apparatus and the time when the paint discharging apparatus actually start/stops the paint discharging operation, see FIG. 11) can be avoided.

Therefore, the contour accuracy of the planned drawing figure drawn on the drawing target face can be effectively increased, and thus it is possible to draw a figure having a smooth and clear contour at the planned drawing location of the drawing target face.

Also, waste on the movement path for moving the paint discharging apparatus outside the area of the planned drawing figure to be drawn at the planned drawing location of the drawing target face can be effectively reduced in comparison to the previous technology, and as a result, the work efficiency of drawing work can also be effectively increased.

A second characteristic configuration of the present invention specifies an embodiment suitable for implementing the first characteristic configuration, and in this second characteristic configuration, the cartesian coordinate robot is installed on a tip portion of an articulated robot arm, and the control apparatus, by controlling the articulated robot arm based on the position information, by operation of the articulated robot arm, moves the cartesian coordinate robot to a position appropriate for drawing of the planned drawing figure at the planned drawing location.

With this configuration, even in a case where it is difficult to move the paint discharging apparatus to a position suitable for drawing the planned drawing figure using only the cartesian coordinate robot (for example, when the drawing target face is the surface of a large object or the surface of an object with a complicated surface shape), the cartesian coordinate robot and the paint discharging apparatus can be easily moved to a position suitable for drawing. Therefore, the planned drawing figure can be appropriately and efficiently drawn at the planned drawing location in the drawing target face.

A third characteristic configuration of the present invention specifies an embodiment suitable for implementing the first or second characteristic configuration, and in this third characteristic configuration, the control apparatus, following drawing of the contour portion of the planned drawing figure by execution of the contour parallel drawing control, draws an inside area adjacent to an area where drawing has been completed in the planned drawing figure by execution of the contour parallel drawing control.

With this configuration, following drawing of the contour portion of the planned drawing figure with high contour accuracy as described above, the inside area of the planned drawing figure can also be efficiently drawn.

A fourth characteristic configuration of the present invention specifies an embodiment suitable for implementing the first or second characteristic configuration, and in this fourth characteristic configuration, the control apparatus, before drawing of the contour portion of the planned drawing figure by execution of the contour parallel drawing control, following starting drawing of the planned drawing figure using a center portion in the planned drawing figure as a drawing start point, draws an outside area adjacent to an area where drawing has been completed in the planned drawing figure by execution of the contour parallel drawing control.

With this configuration, it is possible to efficiently draw the inside area of the planned drawing figure before drawing the contour portion of the planned drawing figure with high contour accuracy as described above.

Also, at the drawing start location where the paint discharging operation of the paint discharging apparatus was started, the drawing error $\Delta e$ due to the above-described time error in the control (see FIG. 11) is likely to occur, and thus a disturbance is likely to occur in the drawing, but in the above configuration, the drawing start point is in the center portion of the planned drawing figure, so even if a disturbance has occurred in the drawing at the drawing start point, in a state in which drawing of the planned drawing figure has been completed (that is, a state in which all of the planned drawing figure has been filled in), the disturbance in the drawing at the drawing start point is difficult to notice. In this regard, according to the above configuration, the planned drawing figure can be drawn even better.

A fifth characteristic configuration of the present invention specifies an embodiment suitable for implementing the first or second characteristic configuration, and in this fifth characteristic configuration, the control apparatus divides the planned drawing figure into a plurality of divided figures by a dividing line that passes through a center portion of the planned drawing figure, and for each of the plurality of divided figures, using the center portion as a drawing start point, draws a contour portion of the divided figure by execution of the contour parallel drawing control.

With this configuration, when each of the plurality of divided figures is viewed independently, the center portion of the planned drawing figure, which is the drawing start point, corresponds to the contour portion of the divided figure. However, when viewing the entire planned drawing figure, the drawing start point in each of the plurality of divided figures is in the center of the planned drawing figure, so as in the above fourth characteristic configuration, even if a disturbance has occurred in the drawing at the drawing start point, in a state in which drawing of all of the planned drawing figure has been completed, the disturbance in the drawing at the drawing start point is difficult to notice. In this regard, according to the above configuration, the planned drawing figure can be drawn even better.

Also, because the contour portion of each of the plurality of divided figures is drawn using the center portion of the planned drawing figure as each drawing start point, discharged paint from the paint discharging apparatus for the vicinity of the center portion of the planned drawing figure is dispersed over time by the number of divided figures. Therefore, it is possible to effectively prevent paint dripping caused by discharged paint being concentrated in time near the center portion of the planned drawing figure.

A sixth characteristic configuration of the present invention specifies an embodiment suitable for implementing the fifth characteristic configuration, and in this sixth characteristic configuration, the control apparatus, following drawing of the contour portion of the divided figure by execution of the contour parallel drawing control, draws an inside area adjacent to an area where drawing has been completed in the divided figure by execution of the contour parallel drawing control.

With this configuration, for each of the plurality of divided figures, similarly to the third characteristic configuration, following drawing of the contour portions of each of the divided figures including the contour portion of the planned drawing figure with high contour accuracy, it is possible to efficiently draw the inside area of the divided figure.

A seventh characteristic configuration of the present invention specifies an embodiment suitable for implementing the first or fifth characteristic configuration, and in this seventh characteristic configuration, the control apparatus, following drawing of a contour portion of the planned drawing figure or a contour portion of the divided figure by execution of the contour parallel drawing control, in a square wave movement mode in which each time the X-axis slider is moved by a set unit movement amount in the Y-axis direction by the Y-axis slider, the paint discharging apparatus is linearly moved in the X-axis direction by the X-axis slider, by execution of an X-axis parallel drawing control that causes the paint discharging apparatus to perform a paint discharging operation to an undrawn area of the planned drawing figure or an undrawn area of the divided figure, draws an undrawn area of the planned drawing figure or draws an undrawn area of the divided figure.

According to this configuration, following drawing of the contour portion of the planned drawing figure or the contour portions of each of the divided figures including the contour portion of the planned drawing figure with high contour accuracy, the inside area of the planned drawing figure or the inside area of the divided figure can be efficiently drawn by the above-described X-axis parallel drawing control.

An eighth characteristic configuration of the present invention specifies an embodiment suitable for implementing the seventh characteristic configuration, and in this eighth characteristic configuration, the X-axis slider moves a discharging apparatus unit, in which a plurality of the paint discharging apparatuses are adjacently aligned in the Y-axis direction, linearly in the X-axis direction, and the control apparatus, when drawing a contour portion of the planned drawing figure or a contour portion of the divided figure by execution of the contour parallel drawing control, causes one paint discharging apparatus in the discharging apparatus unit to perform a paint discharging operation, and when drawing an undrawn area of the planned drawing figure or an undrawn area of the divided figure by execution of the X-axis parallel drawing control, increases the number of paint discharging apparatuses caused to perform a paint discharging operation in the discharging apparatus unit.

With this configuration, the undrawn area in the planned drawing figure or the undrawn area in the divided figure is drawn by a plurality of paint discharging apparatuses with an increased number of operating apparatuses, so those undrawn areas can be drawn even more efficiently.

A ninth characteristic configuration of the present invention specifies an embodiment suitable for implementing any of the first to eighth characteristic configurations, and in this ninth characteristic configuration, the control apparatus, when drawing of the planned drawing figure for one planned drawing location is completed, based on position information of each of the plurality of planned drawing locations in the drawing target face, among the undrawn planned drawing locations, transitions to drawing of the planned drawing figure for the planned drawing location that has the shortest separation distance from the planned drawing location for which drawing of the planned drawing figure was most recently completed.

With this configuration, when drawing a plurality of planned drawing figures on the drawing target face, the movement distance of the paint discharging apparatus and the movement distance of the cartesian coordinate robot between the planned drawing locations of each planned drawing figure can be shortened. Therefore, the work efficiency of drawing work can be increased.

A tenth characteristic configuration of the present invention relates to a method of operating the automatic drawing system according to the first characteristic configuration, the method including: a step of the control apparatus, in drawing of a contour portion in the planned drawing figure, as control for the cartesian coordinate robot and the paint discharging apparatus, executing a contour parallel drawing control; a step of the control apparatus, in the contour parallel drawing control, based on the figure data, by operation of the cartesian coordinate robot, moving the paint discharging apparatus parallel to a contour line of the planned drawing figure to be drawn at the planned drawing location; and a step of the control apparatus, along with movement of the paint discharging apparatus, causing the paint discharging apparatus to continuously perform a paint discharging operation.

With this operation method, similar to the effects according to the above-described first characteristic configuration, in the drawing of the contour portion in the planned drawing figure, occurrence of the drawing error $\Delta e$ as described above (that is, the drawing error that occurs between the end of each drawing line segment L that extends in the X-axis direction and the contour line g of the planned drawing figure G, caused by a time error that occurs between the time when the control apparatus gives a paint discharging operation ON/OFF command to the paint discharging apparatus and the time when the paint discharging apparatus actually start/stops the paint discharging operation, see FIG. 11) can be avoided.

Therefore, the contour accuracy of the planned drawing figure drawn on the drawing target face can be effectively increased, and thus it is possible to draw a figure having a smooth and clear contour at the planned drawing location of the drawing target face.

Also, waste on the movement path for moving the paint discharging apparatus outside the area of the planned drawing figure to be drawn at the planned drawing location of the drawing target face can be effectively reduced in comparison to the previous technology, and as a result, the work efficiency of drawing work can also be effectively increased.

BEST MODE FOR CARRYING OUT THE INVENTION

Figure 1:
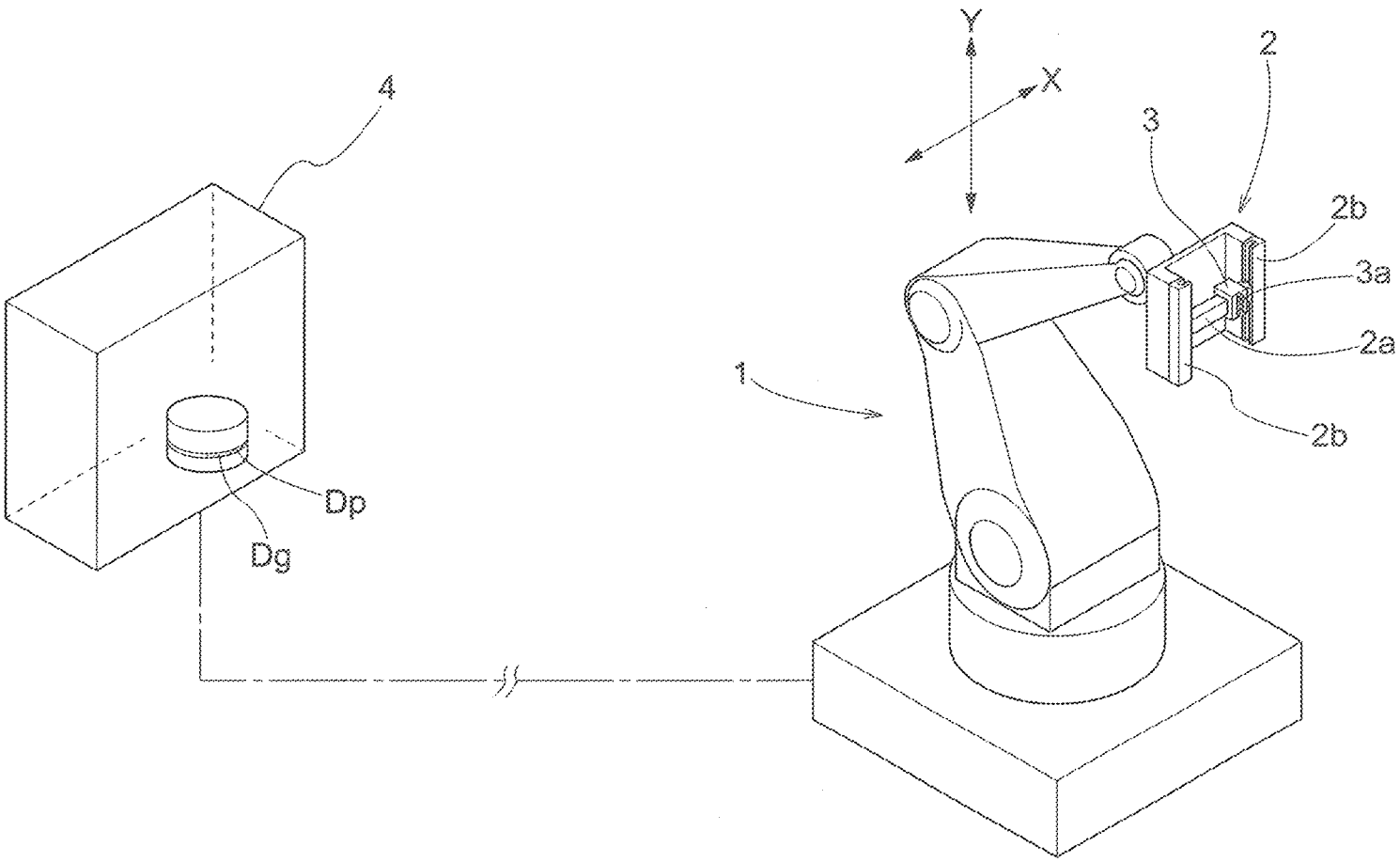
FIG. 1 is a perspective view showing the overall configuration of an automatic drawing system.

FIG. 1 shows an automatic drawing system. This automatic drawing system draws figures such as characters or designs on an aircraft or a vehicle, or on a wall or a bulletin board.

This automatic drawing system is provided with an articulated robot arm 1, a cartesian coordinate robot 2, a dispenser 3 (a paint discharging apparatus), and a control apparatus 4. Also, the cartesian coordinate robot 2 is attached to a tip portion of the articulated robot arm 1.

The cartesian coordinate robot 2 is provided with an X-axis slider 2*a* and a Y-axis slider 2*b*. The dispenser 3 is attached to a traveling base (moving base) of the X-axis slider 2*a*.

That is, the dispenser 3 moves linearly in the X-axis direction due to operation of the X-axis slider 2*a*. The X-axis slider 2*a* provided with the dispenser 3 moves linearly in the Y-axis direction orthogonal to the X-axis direction due to operation of the Y-axis slider 2*b*.

Therefore, the dispenser 3 can move in any direction on the orthogonal X-Y coordinate system by a combination of operation of the X-axis slider 2*a* and operation of the Y-axis slider 2*b*.

The control apparatus 4 controls each of the articulated robot arm 1, the cartesian coordinate robot 2, and the dispenser 3. Figure data Dg of a planned drawing figure G to be drawn at a planned drawing location on a drawing target face S of a drawing target, and position information Dp of the planned drawing location of the planned drawing figure G on the drawing target face S, are entered to the control apparatus 4.

Regarding the figure data Dg of the planned drawing figure G, image data obtained by capturing an image of an original figure with an imaging apparatus such as a scanner or a camera, or alternatively, drawing data of an original figure created with a drawing apparatus such as a CAD drawing, undergoes conversion processing that converts the data into a data format compatible with the automatic drawing system, or adjustment processing that adjusts the size or the like of the figure. Then, the figure data created by such conversion processing or adjustment processing is input to the control apparatus 4 as the figure data Dg of the planned drawing figure G.

Also, regarding the position information Dp of the planned drawing location, by designating the coordinates of the position where the planned drawing figure G is to be drawn on an image that represents the drawing target face S, the designated coordinates are input to the control apparatus 4 as the position information Dp of the planned drawing location of the planned drawing figure G.

Also, the control apparatus 4, based on the figure data Dg of the planned drawing figure G and the position information Dp of the planned drawing location, controls operation of the articulated robot arm 1, operation of each of the X-axis slider 2*a* and the Y-axis slider 2*b* in the cartesian coordinate robot 2, and also a paint discharging operation of the dispenser 3.

Specifically, the control apparatus 4, by controlling the articulated robot arm 1 based on the position information Dp of the planned drawing location on the drawing target face S, by operation of the articulated robot arm 1, moves the cartesian coordinate robot 2 to a position appropriate for drawing the planned drawing figure G at the planned drawing location of the drawing target face S (that is, a position where the cartesian coordinate robot 2 faces the planned drawing location in a state near the planned drawing location). Then, the cartesian coordinate robot 2 is held at that position.

Afterward, the control apparatus 4, by controlling the cartesian coordinate robot 2 and the dispenser 3 based on the figure data Dg of the planned drawing figure G, causes the dispenser 3 to perform a paint discharging operation in coordination with movement of the dispenser 3.

That is, in coordination with the movement of the dispenser 3 by the cartesian coordinate robot 2, drawing paint is discharged from a paint discharge nozzle 3*a* of the dispenser 3 to the drawing target face S, whereby the planned drawing figure G is drawn at the planned drawing location of the drawing target face S by the discharged paint.

Figure 2:
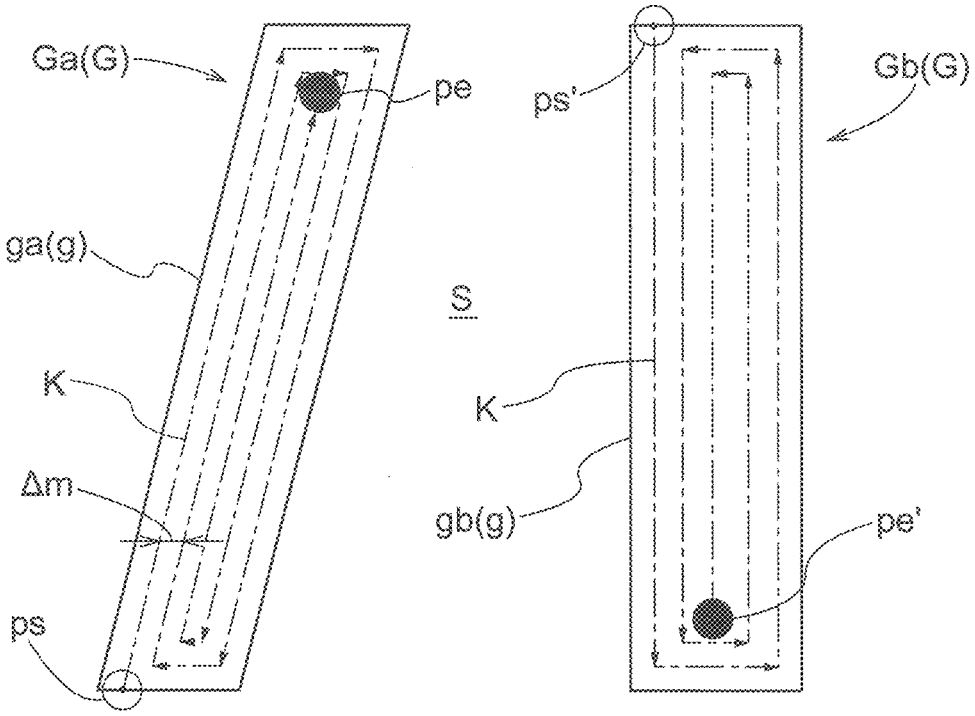
FIG. 2 illustrates a drawing mode for a planned drawing figure.

FIG. 2 schematically shows a movement path K of the dispenser 3 for the planned drawing figure G, and the start/stop timing of a paint discharging operation of the dispenser 3. In FIG. 2, starting of a paint discharging operation of the dispenser 3 is indicated by unfilled circles, and stopping of the paint discharging operation is indicated by solid circles.

That is, a configuration is adopted in which the control apparatus 4, after moving the cartesian coordinate robot 2 to a position appropriate for drawing the planned drawing figure G by operation of the articulated robot arm 1, in order to cause the dispenser 3 to draw the planned drawing figure G shown in FIG. 2 (here, a figure composed of a left side figure Ga and a right side figure Gb separated from each other), executes the following control steps 'a.' to 'd.'.

a. By controlling the cartesian coordinate robot 2 based on the figure data Dg of the planned drawing figure G, by operation of the cartesian coordinate robot 2, the dispenser 3 is moved parallel to a contour line ga of the left side figure Ga from a set drawing start point ps (here, at the lower left corner of the left side figure Ga) in a contour portion of the left side figure Ga to be drawn on the drawing target face S, over the entire circumference of the left side figure Ga, to a point adjacent to the set drawing start point ps.

Also, along with parallel movement of the dispenser 3 with respect to the contour portion, the dispenser 3 is continuously caused to perform a paint discharging operation.

That is, in the control step of 'a.', as control for the cartesian coordinate robot 2 and the dispenser 3, along with moving the dispenser 3 parallel to the contour line g of the planned drawing figure G, a "contour parallel drawing control" that causes the dispenser 3 to continuously perform a paint discharging operation is executed by the control apparatus 4 in the drawing of the entire circumference of the contour portion of the left side figure Ga. Thus, the entire circumference of the contour portion of the left side figure Ga is drawn by paint discharged from the dispenser 3.

b. When the drawing of the contour portion in the left side figure Ga by the control step in "a." above is completed, by controlling the cartesian coordinate robot 2 based on the figure data Dg of the planned drawing figure G, by operation of the cartesian coordinate robot 2, the dispenser 3 is moved, in the form of a single continuous line from the contour portion of the left side figure Ga, in an adjacent inside area of the contour portion in the left side figure Ga (that is, an area where drawing is completed), parallel to the contour line ga of the left side figure Ga (that is, the dispenser 3 is moved on a movement path K shifted toward the inside of the figure by Δm from the prior movement path K).

Also, along with this movement of the dispenser 3 with respect to the inside area, by control with respect to the dispenser 3, the dispenser 3 is controlled to continuously perform a paint discharging operation in succession following the drawing of the contour portion of the left side figure Ga.

Then, when the dispenser 3 completes the paint discharging operation with respect to a set drawing stop point pe in the inside area (here, the upper end of the inside area), the paint discharging operation of the dispenser 3 is stopped.

That is, in this control step of "b.", the above "contour parallel drawing control" is executed by the control apparatus 4, after drawing of the contour portion of the left side figure Ga, in the drawing of the inside area adjacent to the contour portion in the left side figure Ga. Thus, the inside area adjacent to the contour portion in the left side figure Ga is drawn by paint discharged from the dispenser 3, and drawing of the left side figure Ga is completed.

c. When the drawing of the left side figure Ga by the control step in "b." above is completed, by controlling the cartesian coordinate robot 2 based on the figure data Dg of the planned drawing figure G, by operation of the cartesian coordinate robot 2, the dispenser 3 is moved from the above-described set drawing stop point pe in the left side figure Ga to a set drawing start point ps' (here, at the upper left corner of the right side figure Ga) in the contour portion of the right side figure Gb.

Then, after moving to the set drawing start point ps', by controlling the cartesian coordinate robot 2 based on the figure data Dg of the planned drawing figure G, similar to the case of the left side figure Ga, by operation of the cartesian coordinate robot 2, the dispenser 3 is moved parallel to a contour line gb of the right side figure Gb from the set drawing start point ps' in the right side figure Gb, over the entire circumference of the right side figure Gb, to a point adjacent to the set drawing start point ps'.

Also, along with parallel movement of the dispenser 3 with respect to this contour portion, the dispenser 3 is continuously caused to perform a paint discharging operation.

That is, in the control step of 'c.', the "contour parallel drawing control" is executed by the control apparatus 4 in the drawing of the entire circumference of the contour portion of the right side figure Gb. Thus, the entire circumference of the contour portion of the right side figure Gb is drawn by paint discharged from the dispenser 3.

d. When the drawing of the contour portion in the right side figure Gb by the control step in "c." above is completed, by controlling the cartesian coordinate robot 2 based on the figure data Dg of the planned drawing figure G, similar to the case of the left side figure Ga, by operation of the cartesian coordinate robot 2, the dispenser 3 is moved, in the form of a single continuous line from the contour portion, in an adjacent inside area of the contour portion in the right side figure Gb (that is, an area where drawing is completed), parallel to the contour line gb of the right side figure Gb.

Also, along with this movement of the dispenser 3 with respect to this inside area, the dispenser 3 is controlled to continuously perform a paint discharging operation in succession following the drawing of the contour portion of the right side figure Gb.

Then, when the dispenser 3 completes the paint discharging operation with respect to a set drawing stop point pe' in the inside area (here, the lower end of the inside area), the paint discharging operation of the dispenser 3 is stopped.

That is, in this control step of "d.", the "contour parallel drawing control" is executed by the control apparatus 4, after drawing of the contour portion of the right side figure Gb, in the drawing of the inside area adjacent to the contour portion in the right side figure Gb. Thus, the inside area adjacent to the contour portion in the right side figure Gb is drawn by paint discharged from the dispenser 3, and drawing of the right side figure Gb is completed, and thus drawing of the planned drawing figure G shown in FIG. 2, composed of the left side figure Ga and the right side figure Gb, ends.

Figure 3:
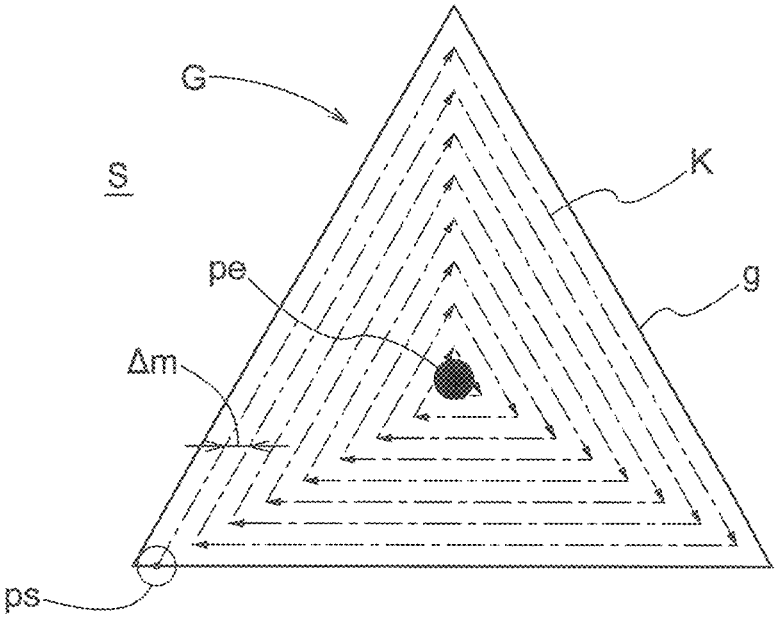
FIG. 3 illustrates a drawing mode for another planned drawing figure.

Also, instead of the planned drawing figure G shown in FIG. 2, FIG. 3 schematically shows a movement path K of the dispenser 3 for another planned drawing figure G, and the start/stop timing of a paint discharging operation of the dispenser 3. As in FIG. 2, in FIG. 3, starting of a paint discharging operation of the dispenser 3 is indicated by an unfilled circle, and stopping of the paint discharging operation is indicated by a solid circle.

That is, the control apparatus 4, after moving the cartesian coordinate robot 2 to a position appropriate for drawing the planned drawing figure G by operation of the articulated robot arm 1, in order to cause the dispenser 3 to draw the planned drawing figure G shown in FIG. 3 (here, a triangular figure), executes the following control steps 'e.' to 'h.', thus causing the dispenser 3 to draw the planned drawing figure G.

e. By controlling the cartesian coordinate robot 2 based on the figure data Dg of the planned drawing figure G, by operation of the cartesian coordinate robot 2, the dispenser 3 is moved parallel to the contour line g of the planned drawing figure G from the set drawing start point ps (here, at the lower left corner of the planned drawing figure G) in a contour portion of the planned drawing figure G to be drawn on the drawing target face S, over the entire circumference of the planned drawing figure G, to a point adjacent to the set drawing start point ps.

Also, along with parallel movement of the dispenser 3 with respect to the contour portion, the dispenser 3 is continuously caused to perform a paint discharging operation.

That is, in the control step of 'e.', the "contour parallel drawing control" is executed by the control apparatus 4 in the drawing of the entire circumference of the contour portion of the planned drawing figure G shown in FIG. 3. Thus, the entire circumference of the contour portion of the planned drawing figure G is drawn by paint discharged from the dispenser 3.

f. When the drawing of the contour portion in the planned drawing figure G by the control step in "e." above is completed, by controlling the cartesian coordinate robot 2 based on the figure data Dg of the planned drawing figure G, by operation of the cartesian coordinate robot 2, the dispenser 3 is moved, in the form of a single continuous line from the contour portion of the planned drawing figure G, in an inside area of a first layer adjacent to the contour portion in the planned drawing figure G (that is, an area where drawing is completed), parallel to the contour line g of the planned drawing figure G.

Also, along with this movement of the dispenser 3 with respect to the inside area of this first layer, the dispenser 3 is caused to continuously perform a paint discharging operation in succession following the drawing of the contour portion of the planned drawing figure G.

That is, in this control step of "f.", the "contour parallel drawing control" is executed by the control apparatus 4, after drawing of the contour portion of the planned drawing figure G, in the inside area of the first layer adjacent to the contour portion in the planned drawing figure G. Thus, the inside area of the first layer adjacent to the contour portion in the planned drawing figure G is drawn by paint discharged from the dispenser 3.

g. When the drawing of the inside area of the first layer adjacent to the contour portion in the planned drawing figure G by the control step in "f." above is completed, by controlling the cartesian coordinate robot 2 based on the figure data Dg of the planned drawing figure G, by operation of the cartesian coordinate robot 2, the dispenser 3 is moved, in the form of a single continuous line from the inside area of the first layer, in an inside area of a second layer adjacent to the inside area of the first layer in the planned drawing figure G (that is, an area where drawing is completed), parallel to the contour line g of the planned drawing figure G.

Also, along with this movement of the dispenser 3 with respect to the inside area of this second layer, the dispenser 3 is caused to continuously perform a paint discharging operation in succession following the drawing of the inside area of the first layer.

That is, in this control step of "g.", the "contour parallel drawing control" is executed by the control apparatus 4, after drawing of the inside area of the first layer of the planned drawing figure G, in the drawing of the inside area of the second layer adjacent to the inside area of the first layer. Thus, the inside area of the second layer adjacent to the inside area of the first layer in the planned drawing figure G is drawn by paint discharged from the dispenser 3.

h. When the drawing of the inside area of the second layer in the planned drawing figure G by the control step in "g." above is completed, the control apparatus 4, based on the figure data Dg of the planned drawing figure G, subsequently, in a mode where the above "contour parallel drawing control" is executed in the same manner as for each of the drawing of the inside area of the first layer and the drawing of the inside area of the second layer, in order of an inside area of a third layer adjacent to the inside area of the second layer, and further an inside area of a fourth layer adjacent to the inside area of the third layer, sequentially and continuously executes the "contour parallel drawing control" in the drawing of the inside area of each layer adjacent to the area where drawing is completed.

Then, when the dispenser 3 finally completes the paint discharging operation for the set drawing stop point pe in the center in the planned drawing figure G, the control apparatus 4 stops the paint discharging operation of the dispenser 3.

That is, following the above control step of "f.", by the control apparatus 4 executing the above control steps of "g." and "h.", drawing of the planned drawing figure G ends.

Figure 4:
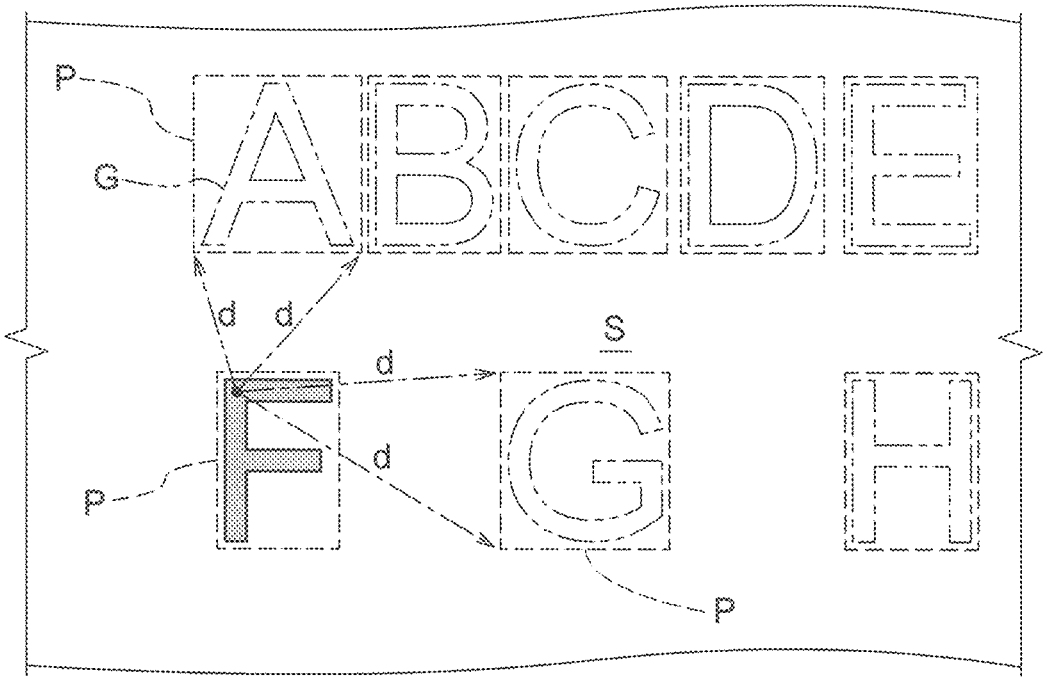
FIG. 4 illustrates an inter-figure movement mode.

On the other hand, as shown in FIG. 4, when drawing the planned drawing figure G at each of a plurality of the planned drawing locations P separated from each other on the drawing target face S, the control apparatus 4, when the drawing of the planned drawing figure G for one planned drawing location P among the plurality of planned drawing locations P is completed, based on the position information Dp of each of the plurality of planned drawing locations P, among the undrawn planned drawing locations P, selects a planned drawing location P that has the shortest distance d from a planned drawing location P for which drawing of the planned drawing figure G was most recently completed as the planned drawing location P for which the planned drawing figure G is to be drawn next. More specifically, in FIG. 4, a search is being performed for the planned drawing location P that has the shortest distance d from a final drawing point in the planned drawing figure G whose drawing was most recently completed.

Then, in a case where there is a large separation distance d between the planned drawing location P for which drawing of the planned drawing figure G was most recently completed and the selected planned drawing location P for which the planned drawing figure G is to be drawn next, the control apparatus 4, by controlling the articulated robot arm 1 based on the position information Dp of the planned drawing location P, by operation of the articulated robot arm 1, moves the cartesian coordinate robot 2 to a position appropriate for drawing of the planned drawing figure G for the next planned drawing location P, and then transitions to drawing of the planned drawing figure G for the next planned drawing location P.

Also, in a case where there is a small separation distance d between the planned drawing location P for which drawing of the planned drawing figure G was most recently completed and the selected planned drawing location P for which the planned drawing figure G is to be drawn next, the control apparatus 4, omitting movement of the cartesian coordinate robot 2 by operation of the articulated robot arm 1, similar to the above-described transition from drawing of the left side figure Ga to drawing of the right side figure Gb shown in FIG. 2, transitions to drawing of the planned drawing figure G for the next planned drawing location P.

As described above, in the present embodiment, a configuration is adopted in which the control apparatus 4, as control for the cartesian coordinate robot 2 and the dispenser 3 (the paint discharging apparatus) in drawing of the contour portion in the planned drawing figure G, based on the figure data Dg, by operation of the cartesian coordinate robot 2, moves the dispenser 3 parallel to the contour line g of the planned drawing figure G to be drawn at the planned drawing location, and along with that movement, executes the "contour parallel drawing control" that causes the dispenser 3 to continuously perform a paint discharging operation.

Also, a configuration is adopted in which the control apparatus 4, following drawing of the contour portion of the planned drawing figure G by execution of the contour parallel drawing control, by similar execution of the contour parallel drawing control, draws an inside area adjacent to an area where drawing has been completed in the planned drawing figure G.

Also, a configuration is furthermore adopted in which, when drawing the planned drawing figure G at each of a plurality of planned drawing locations P on the drawing target face S, the control apparatus 4, when drawing of the planned drawing figure G for one planned drawing location P is completed, based on the position information Dp of each of the plurality of planned drawing locations P, among the undrawn planned drawing locations P, transitions to drawing of the planned drawing figure G for a planned drawing location P that has the shortest separation distance d from a planned drawing location P for which drawing of the planned drawing figure G was most recently completed.

Other Embodiments

Next, other embodiments of the present invention will be listed.

Figure 5:
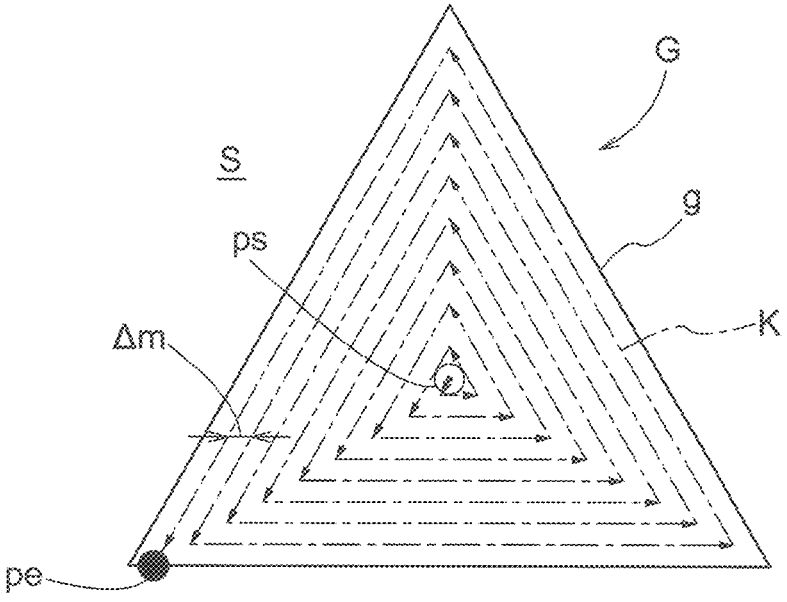
FIG. 5 illustrates a drawing mode in another embodiment.

In the above embodiment, an example is given in which, following drawing of the contour portion of the planned drawing figure G by the contour parallel drawing control, by similar contour parallel drawing control, an inside area adjacent to an area where drawing has been completed in the planned drawing figure G is sequentially drawn, but instead, a configuration may be adopted in which the planned drawing figure G is drawn in the drawing mode shown in FIG. 5.

That is, in the drawing mode shown in FIG. 5, the control apparatus 4, after moving the cartesian coordinate robot 2 by operation of the articulated robot arm 1 to a position appropriate for drawing of the planned drawing figure G, by controlling the cartesian coordinate robot 2 and the dispenser 3 based on the figure data Dg of the planned drawing figure G, causes the dispenser 3 to perform the paint discharge operation in a center portion of the planned drawing figure G, using a center portion of the planned drawing figure G to be drawn on the drawing target face S as the set drawing start point ps. Also, following this, an outside area (that is, an area where drawing is to be performed according to a movement path K shifted toward the outside of the figure by Δm from the prior movement path K) adjacent to an area where drawing has been completed in the planned drawing figure G is sequentially drawn continuously in the form of a single line by the contour parallel drawing control.

Finally, the entire circumference of the contour portion of the planned drawing figure G is similarly drawn by the contour parallel drawing control, and thus drawing of the planned drawing figure G is ended.

Figure 6:
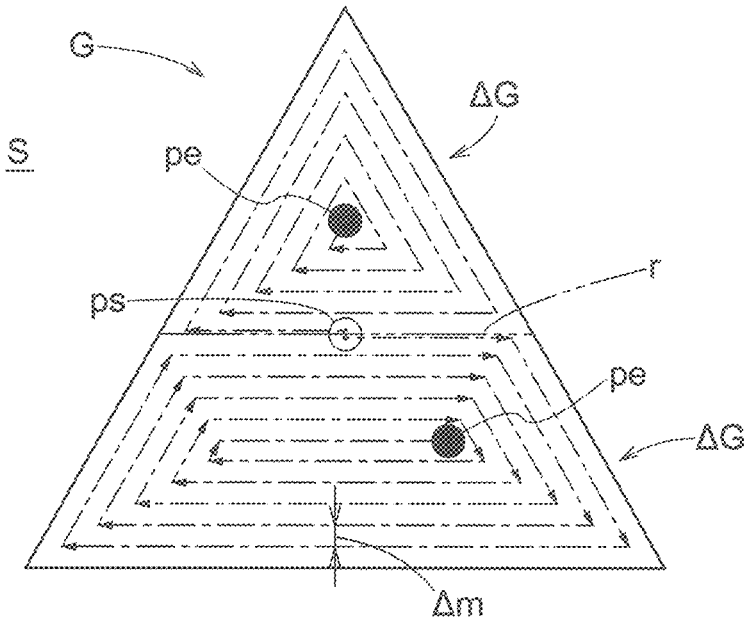
FIG. 6 illustrates a drawing mode in another embodiment.

Also, instead of the drawing mode disclosed in the above-described embodiment or the drawing mode shown in FIG. 5, the planned drawing figure G may be drawn in the drawing mode shown in FIG. 6.

That is, in the drawing mode shown in FIG. 6, the control apparatus 4, based on the figure data Dg of the planned drawing figure G, divides the planned drawing figure G to be drawn at the planned drawing location into a plurality of divided figures ΔG by a virtual dividing line r that passes through the center portion of the planned drawing figure G.

Then, for each of the plurality of divided figures ΔG, similar to the drawing mode shown in above-described FIG. 5, the control apparatus 4, using the center portion of the planned drawing figure G as the set drawing start point ps, after drawing the entire circumference of the contour portion of the divided figure ΔG by the contour parallel drawing control, sequentially draws an inside area adjacent to an area where drawing has been completed in the divided figure ΔG by the contour parallel drawing control, and thus completes drawing of the planned drawing figure G.

Figure 7:
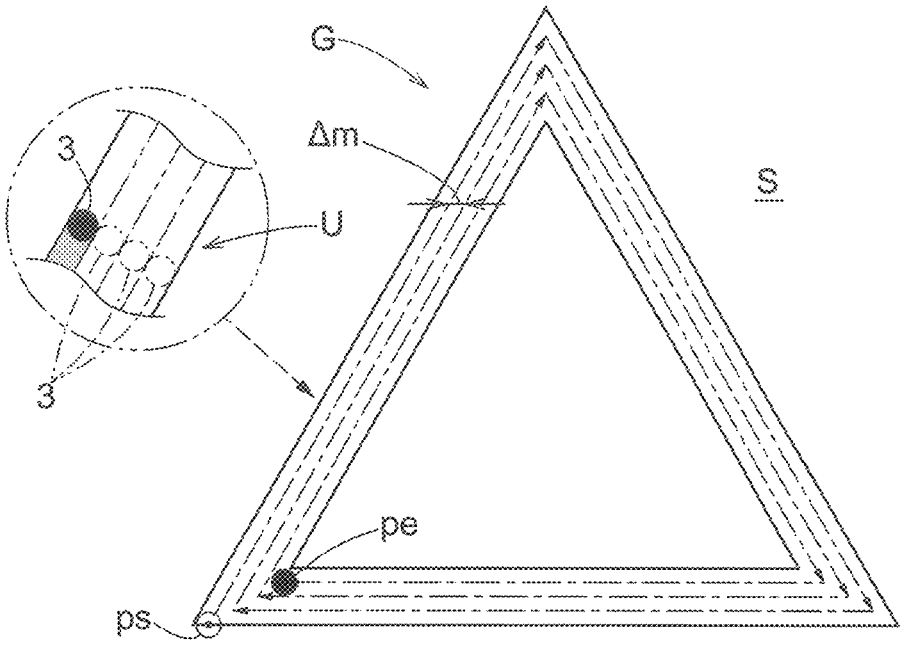
FIG. 7 illustrates a drawing mode in another embodiment.
Figure 8:
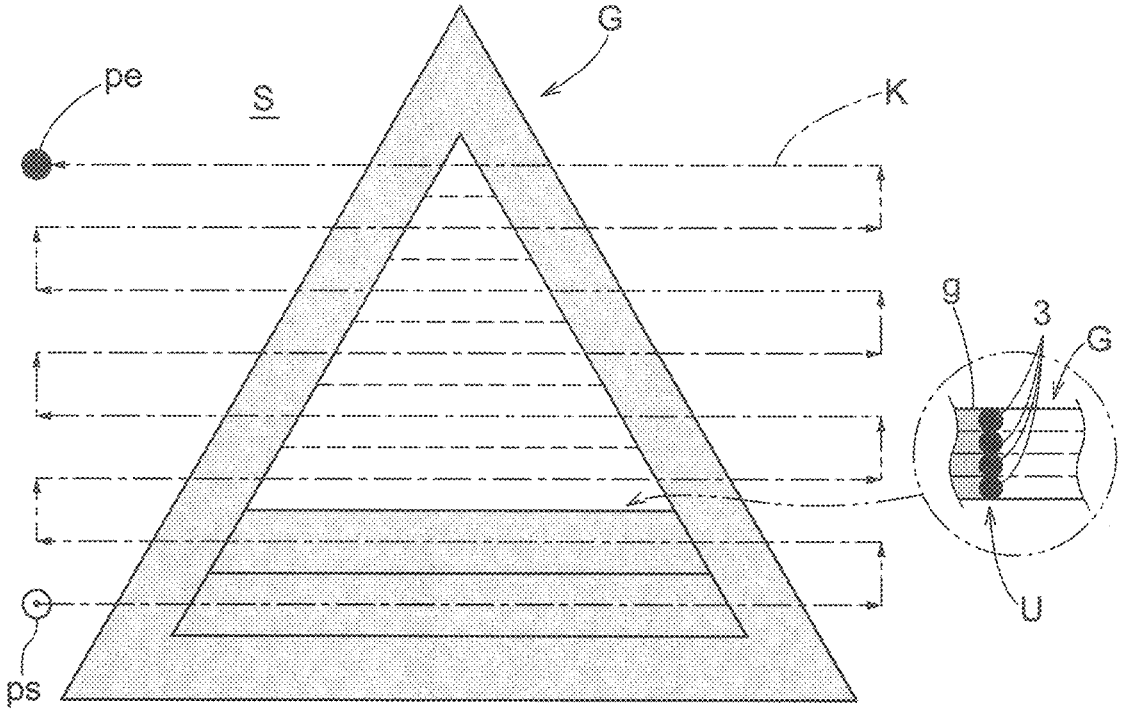
FIG. 8 illustrates a drawing mode in another embodiment.

In the above examples, in every case the planned drawing figures G are drawn by the contour parallel drawing control alone, but instead, the planned drawing figure G may be drawn in the drawing mode shown in FIGS. 7 and 8.

That is, in the drawing mode shown in FIGS. 7 and 8, the control apparatus 4 first draws the entire circumference of the contour portion of the planned drawing figure G by the contour parallel drawing control, as shown in FIG. 7.

Then, following drawing of this contour portion, as shown in FIG. 8, in a square wave movement mode in which each time the X-axis slider 2*a* is moved by a set unit movement amount Δy in the Y-axis direction by the Y-axis slider 2*b*, the dispenser 3 is linearly moved in the X-axis direction by the X-axis slider 2*a*, the control apparatus 4, by an X-axis parallel drawing control that causes the dispenser 3 to perform a paint discharging operation to an undrawn area of the planned drawing figure G, draws an undrawn area inside of the planned drawing figure G.

Note that a configuration may also be adopted in which, similar to the drawing mode shown in FIGS. 7 and 8, after drawing the contour portion of the divided figure ΔG by the contour parallel drawing control in the drawing mode shown in FIG. 6, the undrawn inside area of the divided figure ΔG is drawn by the above-described X-axis parallel drawing control.

Also, as shown in the enlarged views in FIGS. 7 and 8, a discharging apparatus unit U, in which a plurality of dispensers 3 are adjacently aligned in the Y-axis direction (strictly speaking, including a direction slightly inclined with respect to the Y-axis direction), is installed on a traveling base of the X-axis slider 2*a* in the cartesian coordinate robot 2, and when drawing the contour portion of the planned drawing figure G and the contour portion of the divided figure ΔG by the contour parallel drawing control, the contour portion of the planned drawing figure G and the contour portion of the divided figure ΔG are drawn in a state where one dispenser 3 in the discharging apparatus unit U is caused to perform a paint discharging operation to reduce the drawing width.

On the other hand, when drawing an undrawn area in the planned drawing figure G or an undrawn area in the divided figure ΔG by the X-axis parallel drawing control, the undrawn area in the planned drawing figure G or the undrawn area in the divided figure ΔG may be drawn in a state where the number of dispensers 3 caused to perform a paint discharging operation in the discharging apparatus unit U is increased to increase the drawing width.

Figure 9:
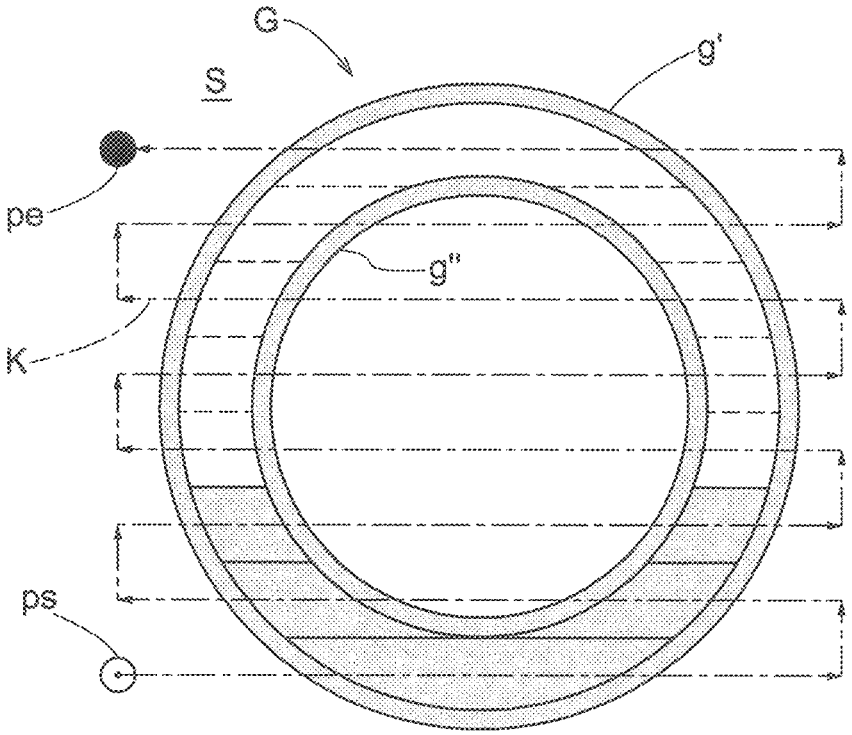
FIG. 9 illustrates a drawing mode in another embodiment.
Figure 10:
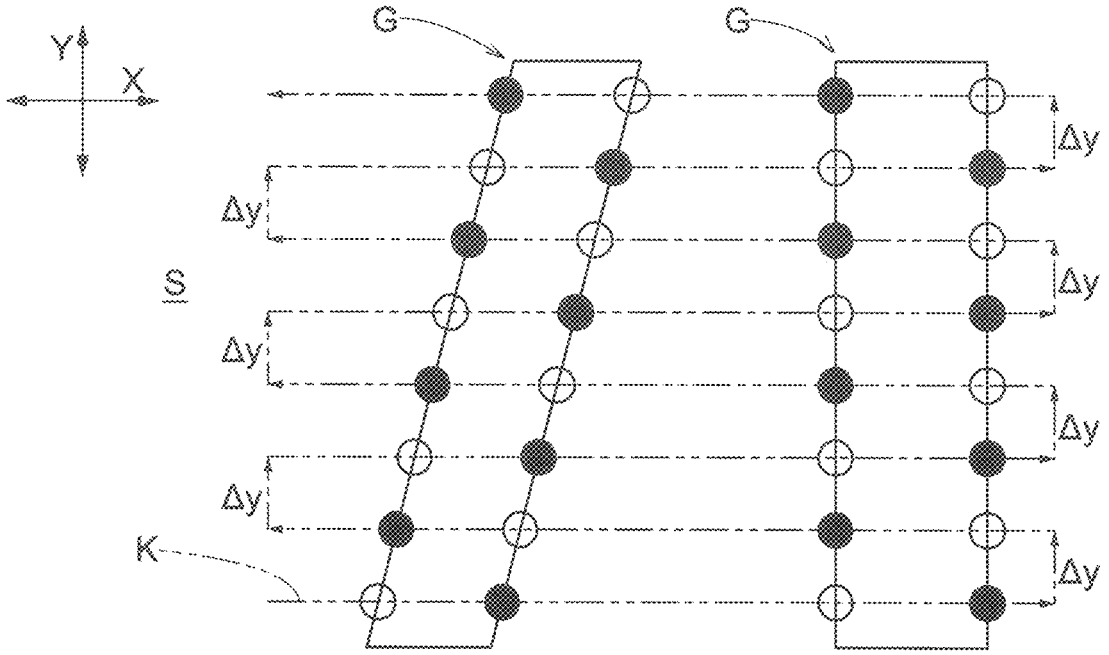
FIG. 10 illustrates a conventional drawing mode.
Figure 11:
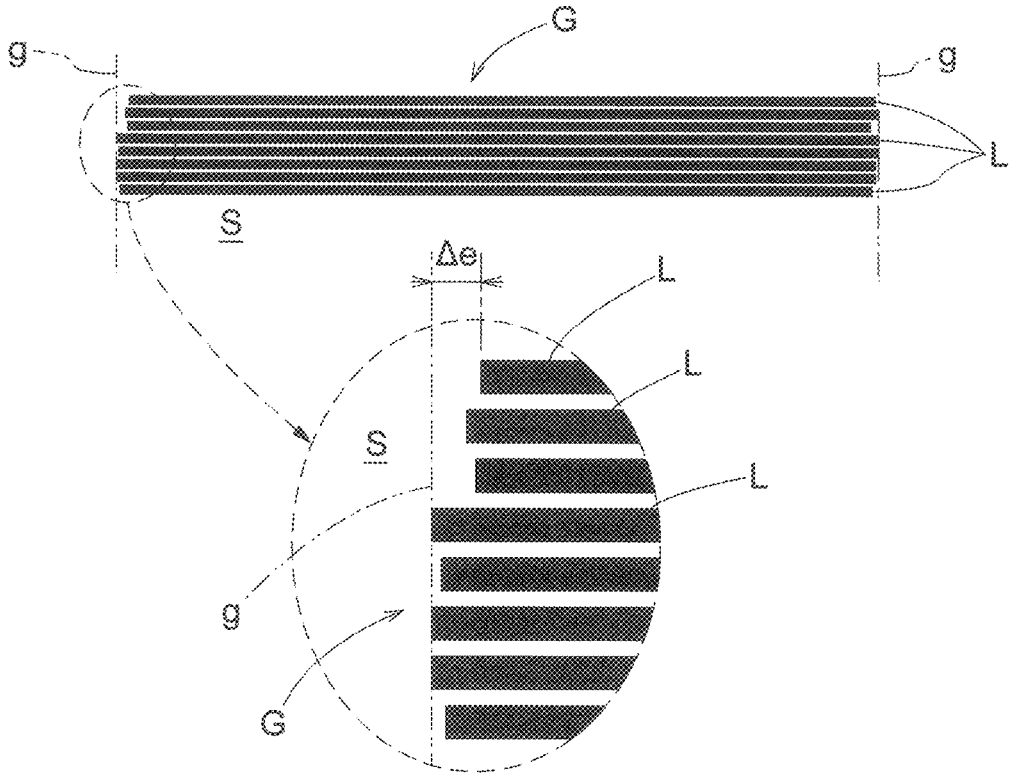
FIG. 11 is a schematic diagram that illustrates a conventional problem.

In a case where the planned drawing figure G is a figure having an inner peripheral side contour line g" independent of an outer peripheral side contour line g' as shown in FIG. 9, a configuration may be adopted in which, as shown in FIG. 9, after the outer peripheral side contour portion and the inner peripheral side contour portion in the planned drawing figure G are successively drawn by the contour parallel drawing control (or alternatively, before drawing those contour portions), an area between the outer peripheral side contour portion and the inner peripheral side contour portion in the planned drawing figure G is drawn by the X-axis parallel drawing control (or by the contour parallel drawing control).

Also, a configuration may be adopted in which, following drawing of either the outer peripheral side contour portion or the inner peripheral side contour portion in the planned drawing figure G by the contour parallel drawing control, an area between the outer peripheral side contour portion and the inner peripheral side contour portion in the planned drawing figure G is drawn by the X-axis parallel drawing control (or by the contour parallel drawing control), and then finally, the other contour portion in the planned drawing figure G is drawn by the contour parallel drawing control.

In a case of, for example, not drawing a single planned drawing figure G by only moving the dispenser 3 by operation of the cartesian coordinate robot 2, but drawing a large planned drawing figure G, a configuration may be adopted in which each time that the cartesian coordinate robot 2 is successively moved to each planned drawing location by operation of the articulated robot arm 1, the dispenser 3 is moved by operation of the cartesian coordinate robot 3 to draw part of the planned drawing figure G. Also, the cartesian coordinate robot 2 may be a three-axis movement-type of robot capable of moving the dispenser 3 also in a Z-axis direction orthogonal to each of the X-axis direction and the Y-axis direction, and the cartesian coordinate robot 2 may be a type of robot capable of moving not only in two axes, but in three or more axes, so as to be compatible with irregularities in the drawing target face S.

DESCRIPTION OF REFERENCE SIGNS

3: dispenser (paint discharging apparatus)
2: cartesian coordinate robot
4: control apparatus
S: drawing target face
2*a*: X-axis slider
2*b*: Y-axis slider
P: planned drawing location
G: planned drawing figure
Dp: position information of planned drawing location
Dg: figure data of planned drawing figure
g: contour line
1: articulated robot arm
ps: drawing start point
r: dividing line
ΔG: divided figure
Δy: set unit movement amount
U: discharge device unit
d: separation distance

The invention claimed is:

1. An automatic drawing system comprising a paint discharging apparatus, a cartesian coordinate robot, and a control apparatus;

the paint discharging apparatus discharging paint toward a drawing target face according to a discharge command given from the control apparatus;

the cartesian coordinate robot having an X-axis slider that linearly moves the paint discharging apparatus in an X-axis direction, and a Y-axis slider that linearly moves the X-axis slider in a Y-axis direction orthogonal to the X-axis direction; and the control apparatus controlling the cartesian coordinate robot and the paint discharging apparatus so as to draw a planned drawing figure at a planned drawing location in the drawing target face by discharging paint from the paint discharging apparatus, based on position information of the planned drawing location and figure data of the planned drawing figure;

wherein the control apparatus, in drawing of a contour portion in the planned drawing figure, as control for the cartesian coordinate robot and the paint discharging apparatus, based on the figure data, by operation of the cartesian coordinate robot, moves the paint discharging apparatus parallel to a contour line of the planned drawing figure to be drawn at the planned drawing location, and along with that movement, executes a contour parallel drawing control that causes the paint discharging apparatus to continuously perform a paint discharging operation, wherein the control apparatus divides the planned drawing figure into a plurality of divided figures by a dividing line that passes through a single drawing start point at a center portion of the planned drawing figure and crosses the planned drawing figure, and for each of the plurality of divided figures, using the single drawing start point as a common drawing start point, draws a contour portion of the divided figure by execution of the contour parallel drawing control.

2. The automatic drawing system according to claim 1, wherein the cartesian coordinate robot is installed on a tip portion of an articulated robot arm, and the control apparatus, by controlling the articulated robot arm based on the position information, by operation of the articulated robot arm, moves the cartesian coordinate robot to a position appropriate for drawing of the planned drawing figure at the planned drawing location.

3. The automatic drawing system according to claim 1, wherein the control apparatus, following drawing of the contour portion of the divided figure by execution of the contour parallel drawing control, draws an inside area adjacent to an area where drawing has been completed in the divided figure by execution of the contour parallel drawing control.

4. The automatic drawing system according to claim 1, wherein the control apparatus, following drawing of a contour portion of the divided figure by execution of the contour parallel drawing control, and in a square wave movement mode in which each time the X-axis slider is moved by a set unit movement amount in the Y-axis direction by the Y-axis slider, the paint discharging apparatus is linearly moved in the X-axis direction by the X-axis slider, by execution of an X-axis parallel drawing control that causes the paint discharging apparatus to perform a paint discharging operation to an undrawn area of the divided figure, draws an undrawn area of the divided figure.

5. The automatic drawing system according to claim 4, wherein the X-axis slider moves a discharging apparatus unit, in which a plurality of paint discharging apparatuses are adjacently aligned in the Y-axis direction, linearly in the X-axis direction, and the control apparatus, when drawing a contour portion of the divided figure by execution of the contour parallel drawing control, causes one paint discharging apparatus in the discharging apparatus unit to perform a paint discharging operation, and when drawing an undrawn area of the divided figure by execution of the X-axis parallel drawing control, increases the number of paint discharging apparatuses caused to perform a paint discharging operation in the discharging apparatus unit.

6. The automatic drawing system according to claim 1, wherein the control apparatus, when drawing of the planned drawing figure for one planned drawing location is completed, based on position information of each of the plurality of planned drawing locations in the drawing target face, among the undrawn planned drawing locations, transitions to drawing of the planned drawing figure for the planned drawing location that has the shortest separation distance from the planned drawing location for which drawing of the planned drawing figure was most recently completed.

7. A method of operating the automatic drawing system according to claim 1, the method comprising:

a step of the control apparatus, in drawing of a contour portion in the planned drawing figure, as control for the cartesian coordinate robot and the paint discharging apparatus, executing a contour parallel drawing control;

a step of the control apparatus, in the contour parallel drawing control, based on the figure data, by operation of the cartesian coordinate robot, moving the paint discharging apparatus parallel to a contour line of the planned drawing figure to be drawn at the planned drawing location;

a step of the control apparatus, along with movement of the paint discharging apparatus, causing the paint discharging apparatus to continuously perform a paint discharging operation;

a step of the control apparatus, in drawing of a contour portion in the planned drawing figure, dividing the planned drawing figure into a plurality of divided figures by a dividing line that passes through a single drawing start point at a center portion of the planned drawing figure and crosses the planned drawing figure; and a step of the control apparatus, for each of the plurality of divided figures, drawing a contour portion of the divided figure by execution of the contour parallel drawing control, using the single drawing start point as a common drawing start point.

* * * * *